US007144187B1

(12) United States Patent
Nolte et al.

(10) Patent No.: US 7,144,187 B1
(45) Date of Patent: Dec. 5, 2006

(54) CABLED MASSIVE SECURITY BARRIER

(75) Inventors: Roger Allen Nolte, Jackson, MO (US); Barclay J. Tullis, Palo Alto, CA (US)

(73) Assignee: Kontek Industries, Inc., New Madrid, MO (US)

( * ) Notice: Subject to any disclaimer, the term of this patent is extended or adjusted under 35 U.S.C. 154(b) by 0 days.

(21) Appl. No.: 11/019,043

(22) Filed: Dec. 20, 2004

Related U.S. Application Data

(63) Continuation-in-part of application No. 10/951,951, filed on Sep. 28, 2004.

(51) Int. Cl.

| | |
|---|---|
| ***E01F 13/00*** | (2006.01) |
| ***E01F 13/02*** | (2006.01) |
| ***E01F 15/00*** | (2006.01) |
| ***E01F 15/02*** | (2006.01) |
| ***E01F 15/04*** | (2006.01) |

(52) U.S. Cl. ..... 404/6; 256/13.1

(58) Field of Classification Search ..... 404/6; 256/13.1

See application file for complete search history.

(56) References Cited

U.S. PATENT DOCUMENTS

| | | | | |
|---|---|---|---|---|
| 2,907,552 A | | 10/1959 | Crone | |
| 3,210,051 A | | 10/1965 | Case | |
| 4,075,473 A | * | 2/1978 | Winston | 256/13.1 |
| 4,113,400 A | | 9/1978 | Smith | |
| 4,433,831 A | * | 2/1984 | Bunger | 256/39 |
| 4,661,010 A | | 4/1987 | Almer et al. | |
| 4,828,425 A | * | 5/1989 | Duckett | 404/6 |
| 4,844,652 A | | 7/1989 | Schroughan | |
| 4,986,042 A | | 1/1991 | Richardt | |
| 5,011,325 A | | 4/1991 | Antonioli | |
| 5,074,704 A | | 12/1991 | McKay | |
| 5,123,773 A | | 6/1992 | Yodock | |
| 5,134,817 A | | 8/1992 | Richardt | |
| 5,149,224 A | | 9/1992 | Smith | |
| 5,156,485 A | | 10/1992 | Ivey et al. | |
| 5,292,467 A | * | 3/1994 | Mandish et al. | 264/112 |
| 5,387,049 A | * | 2/1995 | Duckett | 404/6 |
| 5,443,324 A | | 8/1995 | Sullivan | |
| 5,464,306 A | | 11/1995 | Cristiano | |
| 5,547,310 A | * | 8/1996 | Muller | 404/6 |
| 5,605,413 A | * | 2/1997 | Brown | 404/6 |
| 5,628,582 A | * | 5/1997 | Nagle | 404/6 |

(Continued)

OTHER PUBLICATIONS

Patent Application No. 10/951,951 filed Sep. 28, 2004 by Roger Allen Nolte, titled "Massive Security Barrier".

*Primary Examiner*—Raymond Addie
(74) *Attorney, Agent, or Firm*—Barclay J. Tullis

(57) ABSTRACT

Masses of composite material are coupled together by means of one or more cables into a longitudinal barrier wall to provide security from terrorist threats by being able to withstand both vehicle collisions and explosive blasts. The one or more cables are routed through tunnels within the masses. The tunnels have tapered openings to protect cable from being sheared apart when adjacent masses slide relative to one-another. Some of the cable is anchored to some of the masses. Each mass that is located at an end of a barrier wall is used to support anchoring means to anchor some of the cable. Such barrier walls are supported by a surface such as a ground surface and can be dragged along such a surface since a ground anchoring means isn't required. Given sufficient cable, such a barrier wall can withstand great longitudinal tension, and can absorb and endure great amounts of mechanical and thermal energy.

21 Claims, 9 Drawing Sheets

U.S. PATENT DOCUMENTS 5,685,665 A * 11/1997 Lembo ..... 404/6
6,164,865 A 12/2000 McCallum
6,413,009 B1 7/2002 Duckett
6,439,801 B1 * 8/2002 Galiana et al. ..... 404/6
6,474,904 B1 * 11/2002 Duckett et al. ..... 404/6
6,533,250 B1 * 3/2003 Arthur ..... 256/13.1
6,719,483 B1 * 4/2004 Welandsson ..... 404/6
6,767,158 B1 7/2004 Consolazio et al.
6,962,328 B1 * 11/2005 Bergendahl ..... 256/13.1
2003/0086761 A1 * 5/2003 Anderson ..... 404/6
2004/0146347 A1 7/2004 Davis et al.

* cited by examiner

FIG. 7A
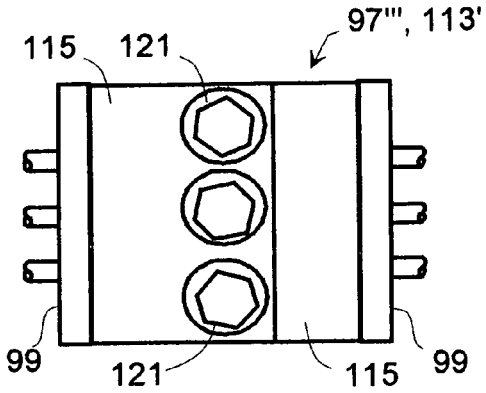
FIG. 7B
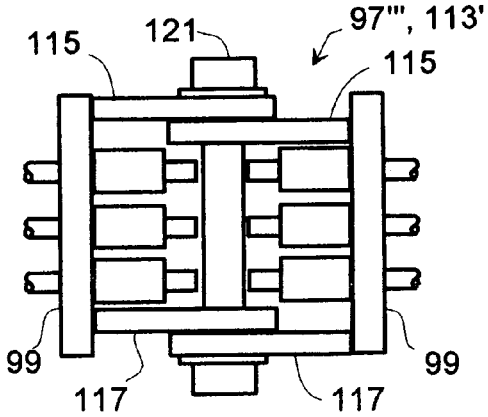
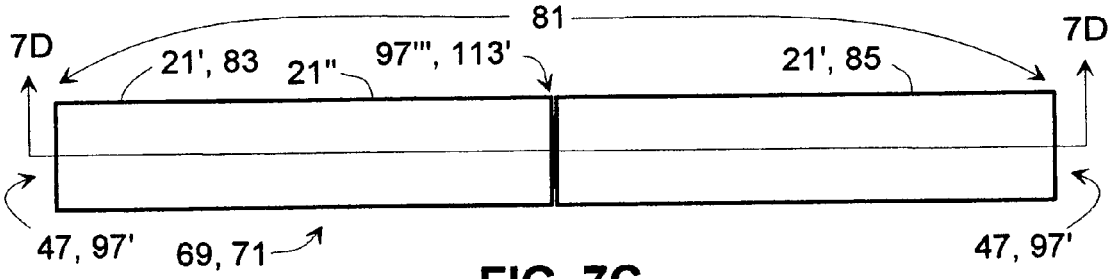
FIG. 7C
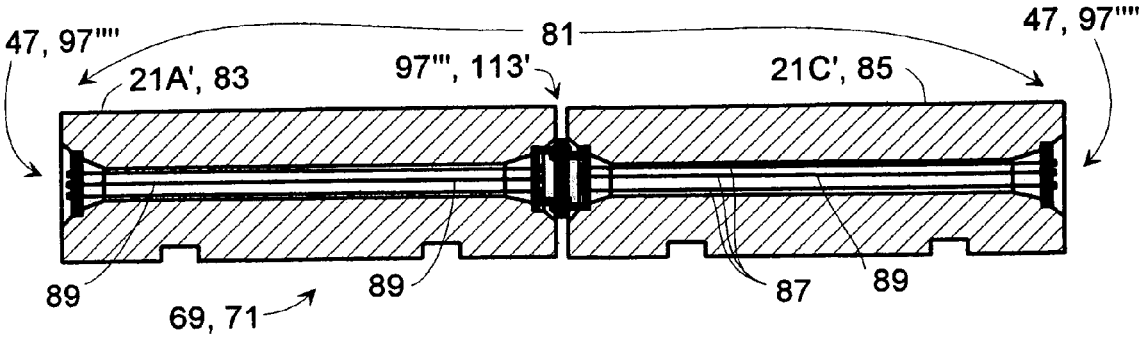
FIG. 7D

FIG. 8A
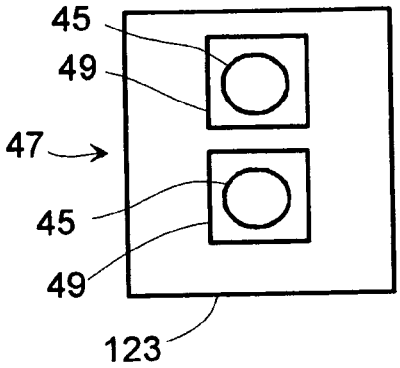
FIG. 8B
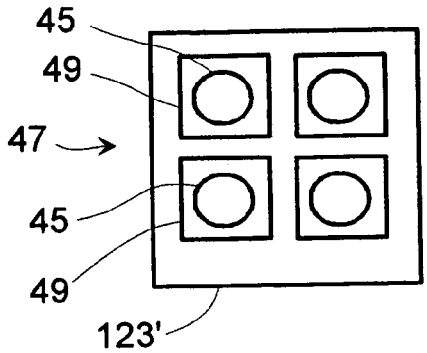
FIG. 9A
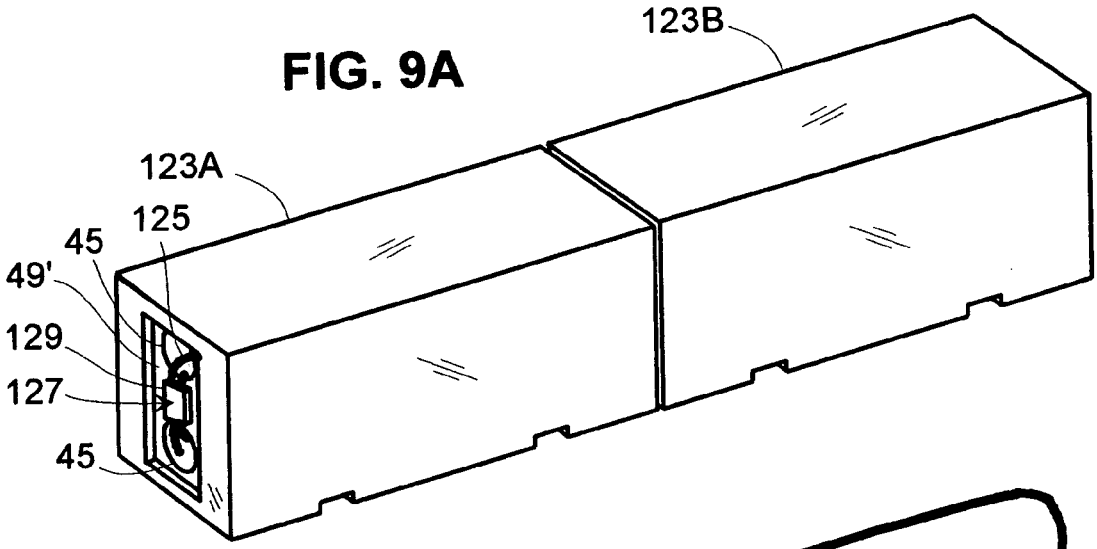
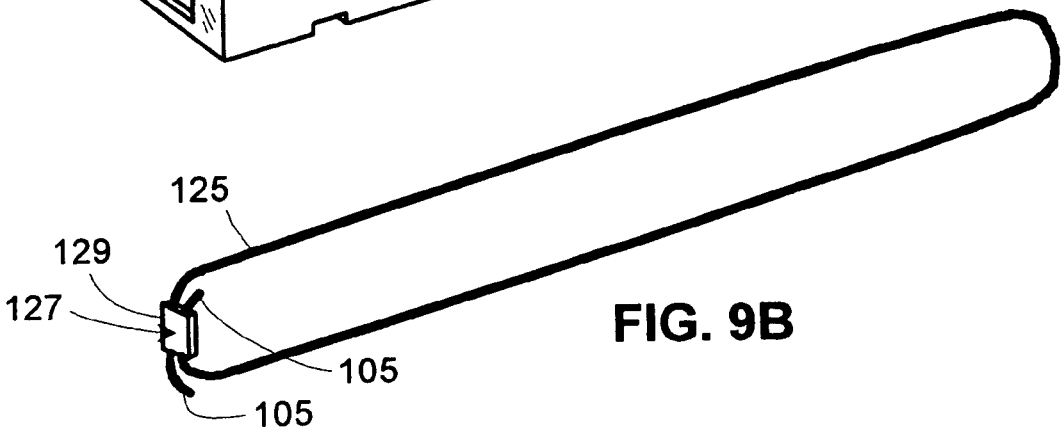
FIG. 9B

CABLED MASSIVE SECURITY BARRIER

CROSS-REFERENCE TO RELATED APPLICATIONS

This application is a Continuation-In-Part of copending U.S. patent application Ser. No. 10/951,951, filed on 28 Sep. 2004, titled "Massive Security Barrier", assigned to the assignee of the present invention, and incorporated herein by reference.

FEDERALLY SPONSORED RESEARCH

Not Applicable

SEQUENCE LISTING OR PROGRAM

Not Applicable

BACKGROUND OF THE INVENTION

1. Field of the Invention

This invention relates to passive barrier elements located on the ground to establish a longitudinal wall that can provide security from terrorist threats by at least slowing, and preferably stopping in a short distance, a vehicle that collides with it, and by providing at least partial protection against blast wave forces, thermal energy, and flying debris from a nearby explosion event.

2. Description of the Related Art

Security zones for protecting sensitive groups of people and facilities, be they private, public, diplomatic, military, or other, can be dangerous environments for people and property if threatened by acts of terrorism. Ground anchored active anti-ram vehicle barriers, bollards, and steel gates may stop a vehicle but do little against a blast wave or blast debris. Earthen berms, sand-filled steel walls, massive concrete or plate steel walls anchored into the ground, or concrete panels laminated with steel sheeting and anchored into the ground have been used to shield against both terrorist vehicles and bombs. But none of these ground-anchored barriers are portable for ease of relocation. Massive barriers of concrete made in segments have traditionally not been strongly coupled together and therefore cannot support high enough tensile forces required to keep a wall from opening up under the force of a straight-on vehicle collision.

Historically, the design of longitudinal barrier systems has focused primarily on issues such as vehicle redirection capability alongside and in divider sections of highways, minimization of vehicle intrusion into a work zone where the vehicle strikes the barrier at a grazing angle, and portability. Many of these barrier systems must be capable of redirecting a variety of different types of vehicles in a smooth and stable manner without causing vehicle rollover; some of these barriers have achieved their design criteria by having high profiles with substantial mass. But the temporary nature of most work zones requires that a barrier system be lightweight and portable so that the barriers can be installed, repositioned, and removed with minimal effort.

Although not relevant to blast protection or stopping straight-on vehicle collisions, some examples of highway barrier wall elements are to be found in the following US patents. U.S. Pat. No. 4,661,010 discloses a roadway defining concrete block held to other blocks a) near their upper portions by U-shaped reinforcement irons cast into the ends of the blocks and linked between blocks using respective threaded vertical pins with nuts to tie to one another by way of a coupling retainer plate and b) near their lower portions by vertically extending pins that link into the bottom end of a vertical tube held in place by the retainer plate. U.S. Pat. No. 4,075,473 discloses a cable-reinforced safety barrier that extends cables through rails and terminates the cables in anchoring means secured to the ground (supporting curb) using bolted fasteners. U.S. Pat. No. 2,907,552 and U.S. Pat. No. 3,210,051 both disclose cabled guardrails wherein the cables used are anchored to the ground at their terminating ends. U.S. Pat. No. 6,767,158 to a "Portable Roadway Barrier" discloses a low-profile barrier formed from an elongated body having an impact surface, a first structure with a key and keyway for fitting adjacent barriers end-to-end to withstand orthogonal and compression forces, and a second structure having support brackets for transferring tensile forces to adjacent barriers, wherein the brackets on adjacent barriers are interconnected with a longitudinally oriented threaded pin. This U.S. Pat. No. 6,767,158 requires the first structure to lie between the second structure and the impact surface. U.S. Pat. No. 5,292,467 to a "Highway Barrier Method" discloses an energy absorbing roadway barrier for dissipating kinetic energy upon impact by a moving vehicle. That barrier has an elongated core of high-density concrete that is anchored to the ground. It has a core that includes prestressed steel rebar members as well as a possibly unstressed central rebar that protrudes from the ends where it can be clamped to those of longitudinally adjacent barriers using a pair of clamping members clamped only to the outside of the rebar. The core is surrounded by a light-weight mixture of cement and sand mixed with such things as polymers and fiberglass. US Patent Application Publication No. 2004/0146347 and U.S. Pat. Nos. 6,413,009; 6,164,865; 5,464,306; 5,443,324; 5,156,485; 5,149,224; 5,134,817; 5,123,773; 5,074,704; 5,011,325; 4,986,042; 4,844,652; and 4,113,400 all disclose various means of keying and/or linking barrier or curbing modules together. US Patent Application Publication No. 2004/0146347 also discloses a plurality of external and continuous cables running the length of the barrier system with which to accommodate longitudinal tension along the entire barrier system. But none of these references include or suggest using a longitudinal cable system running through tunnels within barrier masses aligned longitudinally. None include or suggest using cable systems in a manner that limits accumulation of cable strain from one length-segment of the cable system to another. None include or suggest a way to absorb energy through tensile strain of cables located within barrier masses not anchored to any ground support. And none include or suggest a way to absorb energy through tensile strain of cables but not also absorbing significant energy through bending or shearing of cables. US Patent Publication No. 2004/0146347, in particular, neither discloses nor suggests a motivation or means to enable one barrier element to transfer roll-producing torque about its longitudinal axis to an adjacent barrier element.

None of these barrier systems have focused on protection of a safe side of a barrier wall from encroachment by a high-speed vehicle striking the opposite side of the wall head-on or otherwise at angles that are nearly perpendicular to the wall, and particularly not with portable barrier elements not anchored into the ground. And none of these barrier systems have also focused on the issues of simultaneous protection from both vehicles and explosive blasts.

Forces directed perpendicularly to the longitudinal direction of a continuous wall not firmly tied into the ground, or forces directed at other large angles to the longitudinal direction, must be counteracted both with resisting inertial forces and with longitudinal reaction forces that can be many times higher than the applied forces. In order to resist being displaced too far sideways, even a massive wall must absorb energy by converting kinetic energy (mechanical or aerodynamic), directed perpendicularly or otherwise obliquely to the wall, into other forms of energy, without suffering too much longitudinal strain or lateral shear. Some of the kinetic energy directed against one part of a wall can be transformed to less threatening kinetic energies directed in other directions and at other parts of the wall. Some of the energy can be absorbed as work done to break apart the materials of the wall, preferably without opening up a break in the wall itself, to permanently stretch and distort the wall, and to crush parts of the colliding vehicle. And some of the kinetic energy can be converted to heat created by friction between the parts of the wall, or through pushing, pulling, and dragging of the wall along the ground. Other forms of energy absorption are potential energies of elastic shearing and bending within the wall elements and within the wall system. Another is the conversion of translational kinetic energy into rotational kinetic energy of barrier elements (about vertical and horizontal axes). What is needed is a barrier wall system that exploits all of these energy absorption mechanisms to the best advantage, and in a manner that won't itself endanger life and property.

The kinetic energy involved in a 9,000 kilogram (19,845 lbm) truck traveling at 80 kilometers/hour (49.71 ml/hr) is approximately 2,266,000 joules of energy (approximately 1,671,000 ft-lbf), which is approximately the work performed by one horse in 0.8442 of an hour (50 minutes and 39 seconds), or approximately 0.6296 of a kilowatt-hour. The energies from a nearby explosion can be even more significant and require a strong and robust wall to withstand being moved significantly or otherwise being blown apart. A thousand kilograms of TNT explosive (0.9842 of a ton of TNT) produces approximately 1,845 times the energy of the aforementioned truck. But the energy of exploding that much explosive material may not be as directed as that of a truck, if not ignited too closely to the wall. The shock wave and ensuing high pressures and temperatures, and the high-velocity rush of gas and blast debris, are diminished at any one location away from the blast by virtue of their being spread out over a greater volume of space. For example, if the above explosive were discharged 5 meters from a barrier wall, it could produce an energy, at an area of wall equivalent to that of the frontal area of a truck (approximately 2 meter by 1 meter), of more than 26.6 Megajoules (11.7 times as much as the truck) although with far less inertial mass.

Thus, a need exists for a better barrier wall design than that which uses conventional low or high profile barriers. A need exists for barrier walls that can withstand both head-on collision forces of speeding terrorist vehicles and explosive blasts, and at the same time be rapidly and cleanly deployable and removable. In addition, these walls need to be low cost to manufacture, ship, install, and remove. And they must not endanger underground utilities when being deployed or removed.

BRIEF SUMMARY OF THE INVENTION

The invention is pointed out with particularity in the appended claims. However, at least some important aspects of the invention are summarized herein.

The current invention is that of a cabled massive security barrier (also referred to hereafter as a barrier wall or as a wall) constructed by linking together two or more heavy masses of composite material, each also called a mass or a barrier mass. These barrier masses are lined up in a longitudinal direction to form a barrier wall that can provide security from terrorist threats by being able to withstand both vehicle collisions and explosive blasts. Two of these masses of composite material, the ones situated at opposite ends of the wall, are called end-location masses. Each of the masses of composite material comprising the barrier wall is prefabricated to include a heavy mass of durable composite material, preferably high strength concrete, cast to include at least a first tunnel extending longitudinally though the mass between opposite ends of the mass. Multiple masses can be positioned on top of the ground (or other supporting surface) to establish a protective barrier wall with at least the first tunnels aligned approximately co-axially and longitudinally to any nearest neighboring mass. One or more cables, or one or more cable systems, can be routed through the tunnels and anchored to the ends of the barrier wall, that is to the end-location masses. The cables, or the one or more cable systems, can also be anchored at additional masses comprising the wall. At least one of the tunnels is flared at one end.

A cabled massive security barrier of this invention can withstand great longitudinal tension, can resist being rolled if multiple tunnels are included within each mass with respective cable systems, and can absorb and endure great amounts of mechanical and thermal energy. When loaded laterally (vertically or horizontally), such as by forces from a nearby explosive blast or by a collision from a moving vehicle, such a barrier wall can act as a structural beam, with at least one cable or cable system in tension, and with the composite material in compression on a side of the barrier wall facing the blast or vehicle. Throughout this disclosure, the terms "cable" and "tension cable" are used synonymously. With sufficient tensile strength in a cable or cable system, vertical edges of the masses in compression can be designed to fail by absorbing significant energy. As lateral forces may move one block laterally relative to another, the cable or cable systems can distort to avoid shear forces from developing on the cables themselves.

When struck by an impact from a colliding terrorist's vehicle or explosive blast, a security wall of the current invention exhibits a property of behavior that absorbs energy from the vehicle or blast. Energy is absorbed by work done to damage the vehicle, in work done to damage masses of composite material comprising portions of the walls, and in work done to slide the wall across the ground or other supporting surface. In the process of sliding, the longitudinal path of the wall becomes distorted, that is it changes shape accompanied by some rotation between individual barrier elements. At the very onset of a collision or explosion event, initial rotation of the masses of composite material that are nearest the event cause large compressive forces near some of their vertical edges, even before a large tension force can develop in the cable(s). The initially large compressive forces break away some of the composite material about those vertical edges, thereby absorbing energy. When lateral displacement later occurs between adjacent sides of any adjacent pair of barrier elements, i.e. transverse to the general longitudinal direction of the distorted wall, the bugled or flared contours of the ends of the tunnels that protect the cable(s) operate to prevent otherwise sharp edges on those adjacent sides from shearing the cable(s) apart.

The barrier masses can be transported by truck, positioned at a security site by using readily available heavy lifting equipment, and can be longitudinally inter-connected by one or more cable systems. The one or more cable systems can be installed by routing cables through the tunnels and using means for anchoring cable to anchor the cable system(s) to two or more of the masses. The invention does not require ground-penetrating anchoring devices, so installation, relocation, and later removal does not endanger underground utilities.

A first embodiment of the invention is a cabled massive security barrier located on top of a supporting surface and comprising a first mass of composite material; wherein said mass of composite material comprises an interior region and an outer surface; wherein said outer surface includes two end regions spaced apart a distance along a longitudinal direction that is generally parallel to said supporting surface; wherein a tunnel defined by the mass of composite material extends longitudinally through said interior region and between said end regions; wherein a cross-sectional dimension of said tunnel increases both smoothly and nonlinearly up to at least one of said end regions along at least a portion of distance between said end regions to comprise a smoothly tapered opening; wherein cable can be routed through the tunnel to protect the cable from damage by an explosive blast and to protect the cable from shear damage at the end regions of the tunnel; wherein the massive security barrier can be cabled to adjacent and similar massive security barriers; and wherein the massive security barrier is free to slide along the supporting surface; whereby said cabled massive security barrier provides for slowing a moving vehicle that collides with it, provides at least partial protection against a blast from a nearby explosion event, and provides a tunnel through which a cable can be safely routed.

According to aspects of the invention, this first embodiment can further comprise: a) additional and similar masses of composite material, each with a respective tunnel and end regions, arranged end-to-end to form at least a length-segment of barrier wall bounded by two of the end regions; b) a cable system comprising at least one cable routed through at least two of the tunnels, wherein said two tunnels are adjacent to one-another; and c) means for anchoring that anchors said cable to at least one of the end regions that bounds the length-segment of barrier wall.

According to aspects of the invention, the first mass of composite material can be a mass of concrete and can include an elastic material component.

According to aspects of the invention, at least one of the tunnels can have a cross-section in a plane perpendicular to the longitudinal direction, and wherein the cross-section has a shape selected from the group consisting of elliptical, circular, rectangular, square, trapezoidal, and polygonal. Furthermore, the cross-section can have an area that gradually increases in size toward the end regions to prevent any sharp edge where the tunnel exits the first mass of composite material at the end regions.

According to aspects of the invention, at least one of the tunnels can have a liner material on at least a portion of its wall surface and adjacent to one of the end regions, and this portion can have a tapered contour along the longitudinal direction, wherein the tapered contour is more than a beveled edge. This liner material can form a liner that is bugle-shaped to flare out at an end of the tunnel, and a respective liner can be located at one or both ends of the tunnel. A bugle-shaped or otherwise tapered liner can include a keying protrusion for anchoring the liner into its mass of composite material.

The first embodiment can further comprise: overlapped segments of the cable; and means of friction-slide clamping used to clamp the overlapped cable segments together; whereby excessive tension force applied along the overlapped segments of cable causes the respective segments to slip in position relative to one another; and whereby the slip under tension absorbs energy while limiting tension forces applied to the cable. According to aspects of the invention, the first embodiment can further comprise additional tunnels; whereby additional cable can be routed through the additional tunnels.

According to aspects of the invention, the cabled massive security barrier can further comprise: means for anchoring cable; wherein the means for anchoring cable anchors the cable to the first mass of composite material at one of the end regions. The cabled massive security barrier can further comprise: a recessed region in one of the end regions; wherein the recessed region accommodates the means for anchoring cable. The means for anchoring cable can comprise a steel plate having cable-routing holes through the steel plate. The cable can have a first cable end, wherein the first cable end is securely anchored using means for anchoring a cable. An obstructing device can be fastened onto the cable at a specific location, wherein the obstructing device prevents the specific location of the cable from passing through a hole provided by the means for anchoring a cable to anchor the cable to the first mass of composite material. Additional means for anchoring cable can comprise means for decoupling cable strain between two of the masses of composite material that are adjacent to one-another. The coupling means can furthermore include at least one bolt having a generally vertical axis situated between the two masses that are adjacent to one-another.

Another embodiment of the invention is a cabled massive security barrier located on top of a supporting surface and comprising: a) multiple masses of composite material, wherein each of the multiple masses comprises a respective interior region and a respective outer surface, wherein each of the outer surfaces includes a respective pair of end regions spaced apart along a longitudinal direction that is generally parallel to said supporting surface, and wherein each of the multiple masses has a respective tunnel extending longitudinally through its respective interior region to inter-connect each of its respective end regions; b) a cable; and c) two instances of means for anchoring cable; wherein said multiple masses of composite material are arranged end-to-end to form a barrier wall that is free to slide along the supporting surface and is not anchored to the supporting surface; wherein two of the masses of composite material are end-location masses located at opposite ends of said barrier wall; wherein each of said end-location masses includes one of said instances of means for anchoring cable; wherein said cable is anchored to each of said end-location masses; wherein said cable is routed through the tunnels from one of the end-location masses to the other; and wherein at least one of the tunnels is flared non-linearly near an end region; whereby said barrier wall is held together by said cable; whereby each of the masses of composite material can be dragged along the supporting surface, thereby pulling and dragging others of the masses also; whereby said barrier wall provides a barrier for slowing a moving vehicle that collides with it; and whereby said barrier wall provides a barrier for at least partial protection against a blast from a nearby explosion event.

The invention also includes a method of assembling a cabled massive security barrier that is free to slide along a supporting surface, comprising the steps of: a) providing multiple masses of composite material, wherein each of the masses comprises two opposite ends spaced apart along a longitudinal direction, wherein the opposite ends of each of the masses are interconnected by a respective tunnel through the respective mass, wherein at least one of the tunnels ends with a non-linearly flared opening, and wherein each of the masses is free to slide along the supporting surface; b) providing cable for implementing a cable system; c) providing means for anchoring cable to at least two of the masses; d) positioning the masses longitudinally end-to-end to form a wall, wherein a first mass of the multiple masses and a last mass of the multiple masses comprise two respective ends to said wall; e) routing said cable through the tunnels of said masses to form a cable system interconnecting said first mass and said last mass; and f) using the means for anchoring cable to anchor said cable to said first mass and said last mass. The method may further comprise the steps of: g) providing at least one additional means of anchoring cable; and h) using the additional means of anchoring cable to anchor the cable system to another of the masses that is other than the first mass and other than the last mass.

OBJECTS AND ADVANTAGES OF THE INVENTION

Objects and advantages of the present invention are cabled massive security barriers (or "barrier walls") that include heavy masses of composite material arranged longitudinally along the ground or other supporting surface, each mass having longitudinally opposite ends and one or more tunnels running between the opposite ends, and tension cable routed through the tunnels and anchored at least to end-masses using any of a variety of means for anchoring cable. One of the objects and advantages of the present invention is that it uses means for anchoring cable that anchor the cable (or cables) to various members of the masses without requiring an anchor to the ground. Such a barrier wall can be durable to vehicle collisions, durable to explosive blasts, energy absorbing, portable, inexpensive to manufacture, inexpensive to deploy, inexpensive to relocate, and inexpensive to remove. Through the use of tension cable arranged to comprise a suitable cable system, rotational forces applied externally to one mass can be transferred into tension forces along the tension cable and into rotational forces on adjacent masses, lateral forces applied externally to one or more masses can be converted to tension forces along the tension cable, and tension forces along the tension cable can result in compressive forces on the masses. The individual masses are resistant to sliding by virtue of their weight and coefficient of friction with the ground (or other supporting surface). With only longitudinal tension forces in the tension cables through tunnels within the masses, it is an object and advantage of the invention that adjacent masses can be slightly offset from one another either or both horizontally or vertically. By virtue of there being no requirement for anchoring the masses or cable to the ground, the cabled massive security barriers of the present invention are non-threatening to utilities located below the ground. And the individual masses can be made available in a variety of architectural designs and surface appearances, can include mounting fixtures for flags and cameras and the like, and can be provided with built-in chases or conduits for utilities.

Further advantages of the present invention will become apparent to the ones skilled in the art upon examination of the drawings and detailed description. It is intended that any additional advantages be incorporated herein.

The various features of the present invention and its preferred implementations may be better understood by referring to the following discussion and the accompanying drawings. The contents of the following discussion and the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention for a cabled massive security barrier (or "barrier wall") may be more readily understood by one skilled in the art with reference being had to the following detailed description of several embodiments thereof, taken in conjunction with the accompanying drawings. Within these drawings, like reference numerals refer to like elements in the several figures, where alphabetic-letter-suffixes denote copies of a part or feature, where primes denote some lack of perfect duplication, and in which:

FIGS. 7A and 7B show respectively a top view and a side view of a combined assembly of two instances of the fourth means for anchoring cable shown in FIGS. 6A–6C. These two instances of the fourth means for anchoring cable are joined together by interconnecting them with three linkage bolts and their respective washers and nuts. This combination, like the means for anchoring cable shown in FIGS. 5A and 5B, comprises a means for decoupling strains.

FIGS. 7C and 7D show respectively a front view and a cross-sectional front view of a barrier wall comprised of two masses of the second embodiment, with the means for decoupling strains, as shown in FIGS. 7A and 7B, located between them.

FIG. 8A shows an end view of an end region of a fourth embodiment of a mass of composite material having a plurality of two tunnels each identical to that shown in FIG. 1C.

FIG. 8B shows an end view of an end region of a fifth embodiment of a mass of composite material having a plurality of four tunnels each identical to that shown in FIG. 1C.

FIG. 9A shows two masses of the fourth embodiment aligned end-to-end and interconnected (interlinked) using a loop of tension cable looped through the two respectively aligned tunnel passageways. The two end-length-segments of the looped tension cable are overlapped with one another within a means of friction-slide clamping.

FIG. 9B shows the configuration of the loop of tension cable and the means of friction-slide clamping used in the embodiment shown in FIG. 9A.

DETAILED DESCRIPTION OF THE INVENTION

Figure 1A:
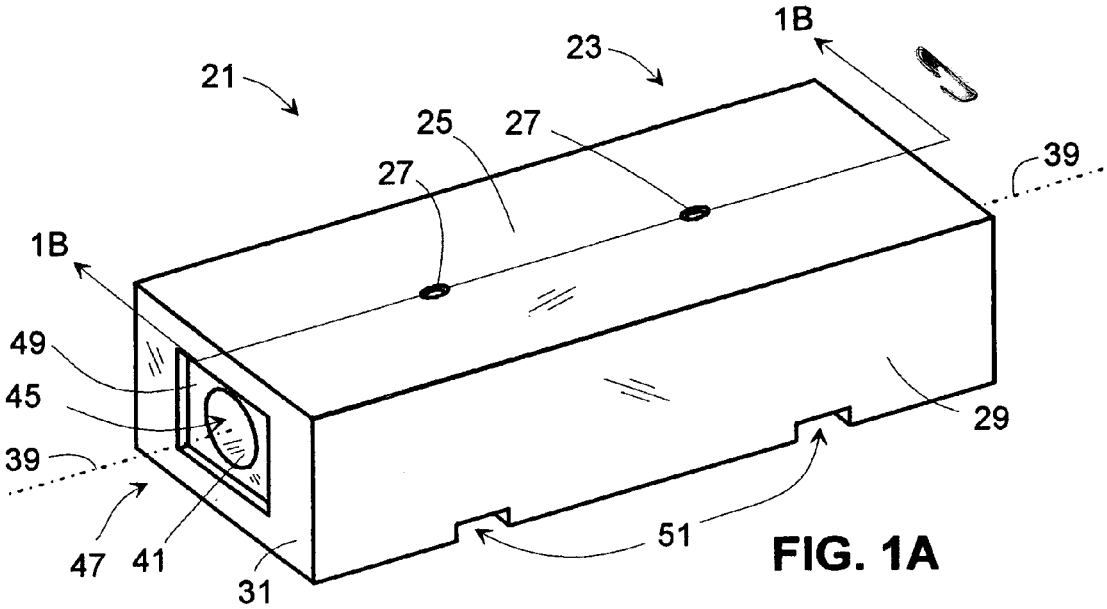
FIGS. 1A, 1B, and 1C show respectively a perspective view, a cross-sectional front view, and an end view of a first embodiment of a mass of composite material as used to comprise a cabled massive security barrier.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

Figure 1B:
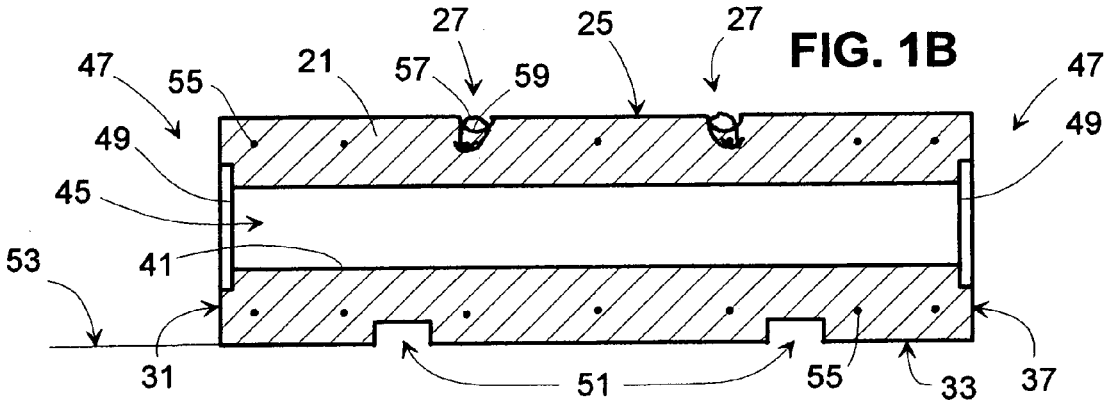
Figure 1C:
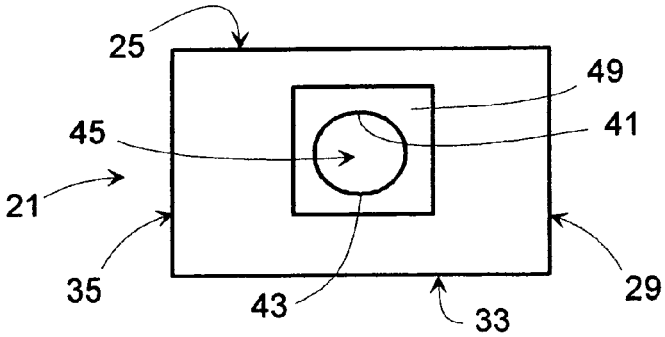

FIGS. 1A, 1B, and 1C show respectively a perspective view, a cross-sectional front view, and an end view of a first embodiment of a mass of composite material 21 as used to comprise a cabled massive security barrier. This first embodiment is shown shaped, for example, as a block with an external surface 23 comprising a top surface 25, a bottom surface 33, a front surface 29, a back surface 35, a first end surface 31, and a second end surface 37. (Note that the adjectives. "first", "second", "third", etc. within this patent specification are not intended as ordinal counts, but rather only as distinguishing labels.) FIG. 1A shows a recessed region 49 that includes an opening to a tunnel 45 at an end region 47 at the first end surface 31. The tunnel 45 is shown with an interior region 41. This tunnel 45 extends between the first end surface 31 and the second end surface 35, as better seen in FIG. 1B. FIG. 1B shows another recessed region 49 which includes another opening of the tunnel 45 at another end region 47 at the second end surface 37. The recessed regions 49 are shown, for example, having a rectangular outline shape, while the tunnel 45 is shown, for example, having a circular (elliptical) shape to its cross-section 43. As shown in FIG. 1A, the tunnel 45 through the mass of composite material 21 has a longitudinal axis 39, and the first and second end surfaces 31 and 37 are spaced apart along a direction parallel to this longitudinal axis 39.

In regard to FIGS. 1A and 1B, a pair of co-parallel grooves 51 are shown located in the bottom surface 33. These grooves 51 are used to receive the lifting arms of a fork-lift machine as, for example, when lifting and maneuvering the mass of composite material 21 during installation, adjustment, removal, loading, unloading, and storage. They also serve as passageways for passage of liquids such as rain water when the mass 21 is placed on a supporting surface such as a roadway, sidewalk, plaza surface, field, or campus grounds.

In regard to FIGS. 1A and 1B, two attachment devices 27 and 27 are shown located in the top surface 25 where rigging can be attached for lifting the mass 21 from above such as by a mobile hydraulic crane or other lifting machinery. As seen in FIG. 1B, these attachment devices 27 can, for example, each be comprised of a rebar loop 57 of steel tied to steel rebar strengthening members 55 used to internally reinforce the overall structure of the mass of composite material 21. The rebar loops 57 can be situated below the top surface 25 and within tie-in cavities 59. FIG. 1B shows an indication of the location of a supporting surface 53 that supports the bottom surface 33 of the mass of composite material 21.

In regard to FIGS. 1A–1C, the mass of composite material 21 can be any dense and strong material, such as high strength concrete, that is resilient to explosive blasts and able to absorb and dissipate energy from a dynamic collision with a moving vehicle. Typical sizes for the mass of composite material range from one to four meters between the end surfaces 69 and 71, two-thirds to two meters between the top and bottom surfaces 61 and 63, and two-thirds to two meters between the front and back surfaces 65 and 67. Typical volumes of the mass of composiste material 47 exceed four-ninths of a cubic meter. Typical weights of the mass of composite material 47 exceed 700 kilograms. One preferred embodiment measures approximately 3 meters between ends (length), 0.9 meters top to bottom (height), and 0.6 meters front to back (depth), for a volume of 1.62 cubic meters; for concrete with a density of 2.3 relative to water, the weight is approximately 3,800 kilograms.

In regard to FIG. 1, one skilled in the art can readily appreciate other features of the mass of composite material 21. For example, the bottom surface 33 may be textured to provide a good grip on a supporting surface such as concrete pavement. The front and back surfaces 29 and 35 may be structured, textured, and finished for aesthetic purposes, for example to match surrounding architectural details of buildings and the like. The top and bottom surfaces 25 and 33 may have keying features that function as self-alignment devices and interlocking devices when stacked upon or under other similar masses to build taller barrier walls or to use storage space efficiently. The top surface 25 may have holes for supporting poles for holding such things as lighting fixtures, loud speakers, and/or surveillance cameras. The back surface 67 may have built-in chases running longitudinally and/or vertically to hide and protect the passage of utility conduits such as for electrical supply for lamps. All external edges of the mass of composite material 21 can have beveled, rounded, or otherwise contoured shapes to prevent accidental breakage.

Figure 2A:
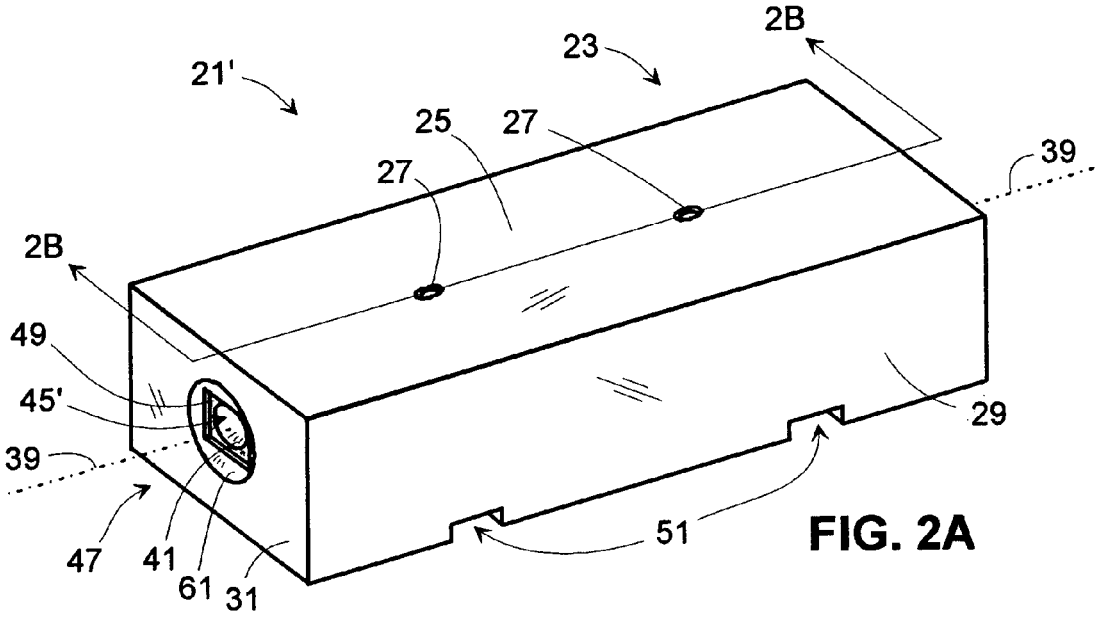
FIGS. 2A, 2B, and 2C show respectively a perspective view, a cross-sectional front view, and an end view of a second embodiment of a mass of composite material as used to comprise a cabled massive security barrier.
Figure 2B:
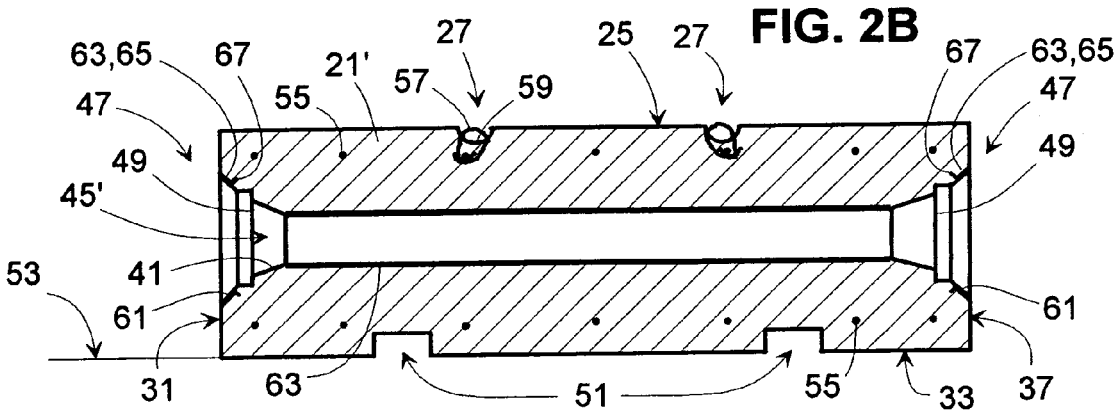
Figure 2C:
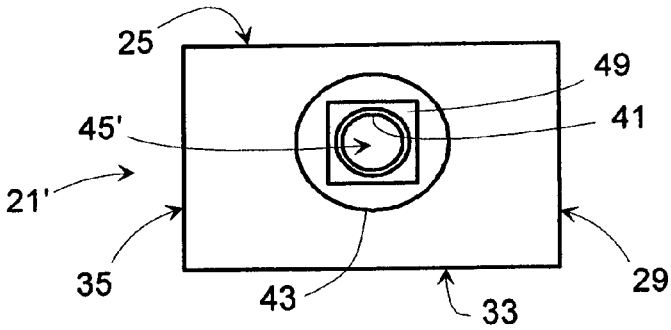

FIGS. 2A, 2B, and 2C show respectively a perspective view, a cross-sectional front view, and an end view of a second embodiment of a mass of composite material 21' as used to comprise a cabled massive security barrier. What is shown in FIGS. 2A–2C is similar to that shown in FIGS. 1A–1C with the exception of how the ends of the tunnels 45 and 45' are shaped, and that the recessed regions 49 are offset in the longitudinal direction toward the middle of the mass 21'. In FIGS. 1A–1C, the tunnel 45 in the first embodiment 21 is shown as cylindrical with a constant diameter size. In FIGS. 2A–2C, the tunnel 45' in the second embodiment 21' is shown with a tapered end 61 to the tunnel 45' at each end region 47. That is, the tunnel 45' opens out at each end region 47 in a flared or bugle shape. In FIG. 2B, the two tapered ends 61 to the tunnel 45' are shown as including bugle-shaped liners 65, preferably of steel, to accommodate rubbing forces from tension cable routed through the tunnel 45'. The bugle-shaped liners 65 can have keying protrusions 65 to help anchor the liners 65 to the mass of composite material 21'. Other portions of the tunnel 45' (or 45) can be lined with a liner material 63 to protect surfaces of the interior region 41.

Figure 3A:
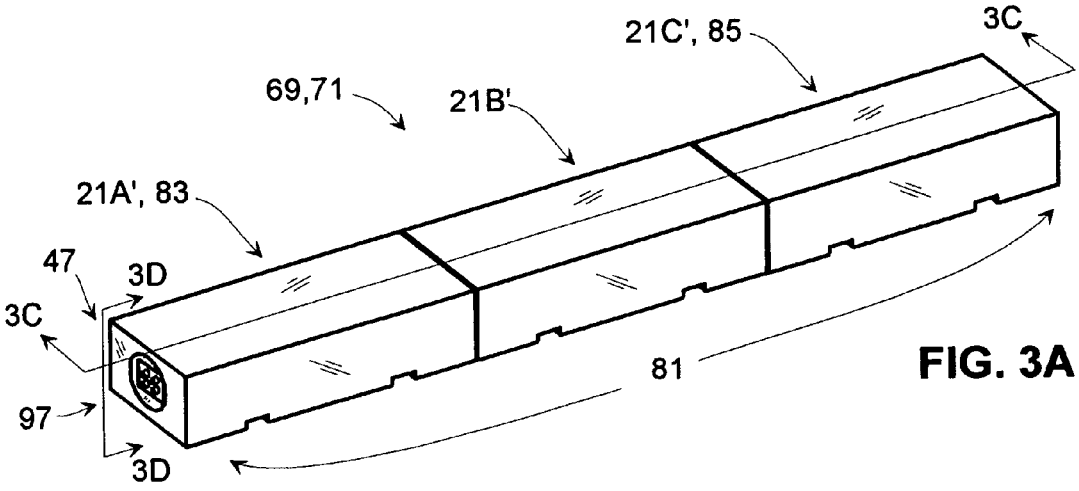
FIG. 3A shows a perspective view of three masses of composite material of the second embodiment aligned end-to-end longitudinally in a row to forming a barrier wall with a first means for anchoring cable to the ends of the barrier wall. This first means for anchoring cable is comprised of four tension cables anchored to a steel plate at each end of the barrier wall.

FIG. 3A shows a perspective view of a cabled massive security barrier 69, also referred to as a barrier wall 71. The barrier wall 71 includes three masses of composite material 21A', 21B', and 21C' of the second embodiment that are aligned end-to-end longitudinally in a row in forming the barrier wall 71. The two masses of composite material at the opposite ends 81 of the barrier wall 71 comprise a first end-location mass 83 and a second end-location mass 85. A first means for anchoring cable 97 is shown anchoring cable to the left-most end region 47 of the barrier wall 71, at the left-most end of the first end-location mass 83. This first means for anchoring cable 97 is shown comprised of four tension cables anchored to a steel plate at the end region 47 of end-location mass 83.

Figure 3B:
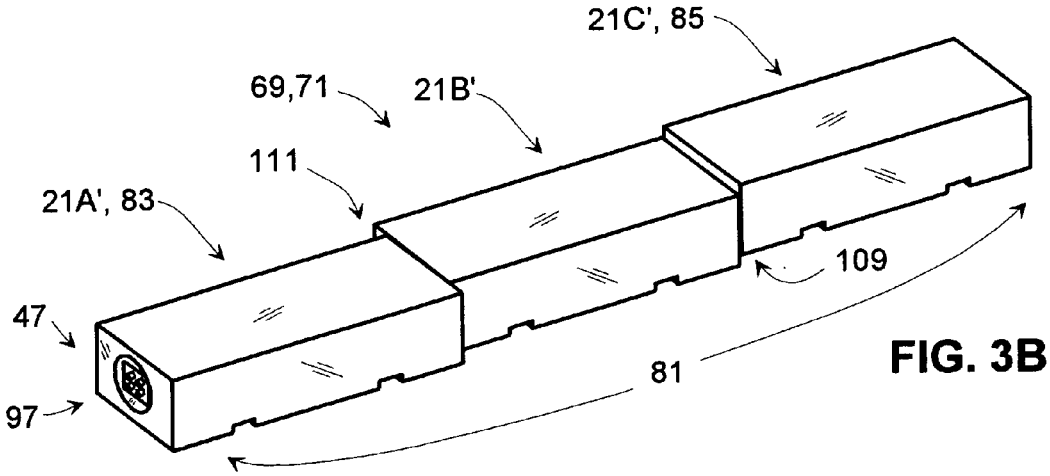
FIG. 3B shows the same barrier wall as in FIG. 3A, except the nearest two masses are laterally (horizontally) offset, and the farthest two masses are vertically offset, the latter to accommodate a grade change in the supporting ground underneath the masses (ground not shown).

FIG. 3B shows the same barrier wall 71 (the same cabled massive security barrier 69) as in FIG. 3A, except the nearest two masses 21A' and 21B' are shown having a lateral offset 111 (horizontally) relative to one another, and the farthest two masses 21B' and 21C' are shown having a lateral offset (vertically) relative to one another caused by a grade change 109 in the supporting ground underneath the masses (ground not shown).

Figure 3C:
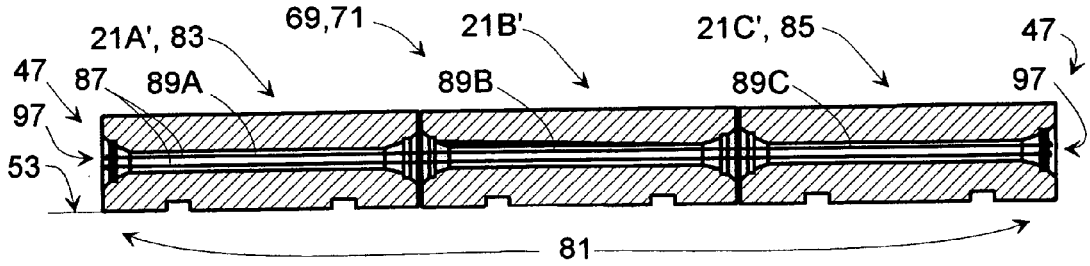
FIG. 3C shows a cross-sectional view from the front of the barrier wall shown in FIG. 3A.

FIG. 3C shows a cross-sectional view from the front of the barrier wall 71 shown in FIG. 3A. In this view, the supporting surface is indicated 53, and the end regions 47 at both of the opposite ends 81 of the barrier wall 71 are shown. Length-portions 89A, 89B, and 89C of tension cable are shown respectively within the tunnels of the individual masses 21A', 21B', and 21C' and comprise a cable system 87 running between two means for anchoring cable 97. These two means for anchoring cable 97 are located respectively at the outer ends 81 of the barrier wall 71.

Figure 3D:
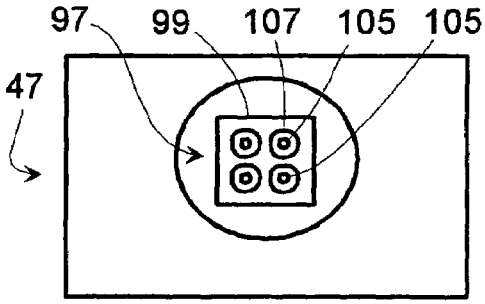
FIG. 3D shows an enlarged end view of the barrier wall shown in FIG. 3A showing also an end view of one of the first means for anchoring cable.

FIG. 3D shows an enlarged end view the end region 47 of the barrier wall 71 shown in FIG. 3A, showing also an end view of one of the first means for anchoring cable 97. This first means for anchoring cable 97 is shown to include a steel plate 99 and four instances of a cable end 105 and a corresponding obstructing device 107. The obstructing devices 107 are attached firmly to the ends 105 of tension cables that pass through cable routing holes 101 (not shown) in the steel plate 99 from the interior of the tunnels 45' (not shown) within the masses 21A', 21B', and 21C'.

Figure 3E:
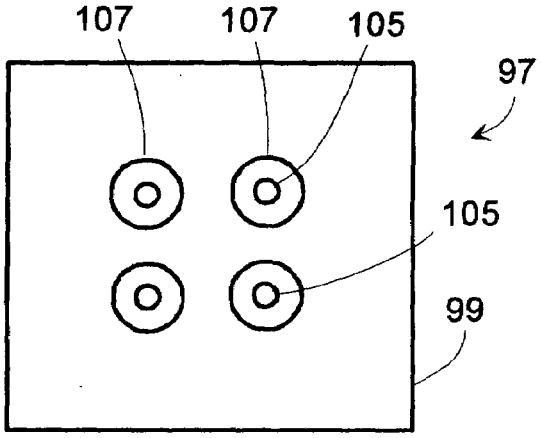
FIGS. 3E and 3F show respectively an end view and a side view (where the latter could also be a top or bottom view) of one of the first means for anchoring cable as used in the barrier wall shown in FIGS. 3A–3C.
Figure 3F:
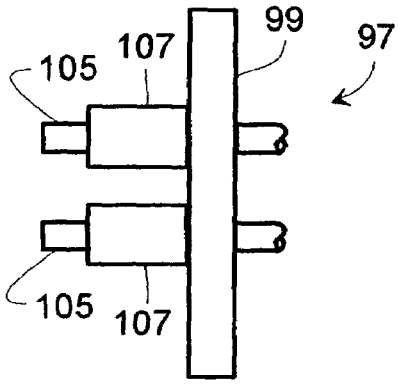

FIGS. 3E and 3F show respectively an end view and a side view (where the latter could also be a top or bottom view) of one of the first means for anchoring cable 97 as used in the barrier wall 71 shown in FIGS. 3A–3C, as shown in FIG. 3D, and as described with reference to FIG. 3D.

Figure 4A:
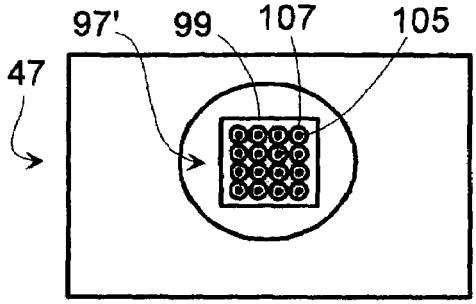
FIGS. 4A, 4B, and 4C are similar to FIGS. 3A, 3B, and 3C, but the means for anchoring cable shown at an end of the barrier wall is a second means for anchoring cable, the difference being the number of tension cables used: 16 instead of 4.
Figure 4B:
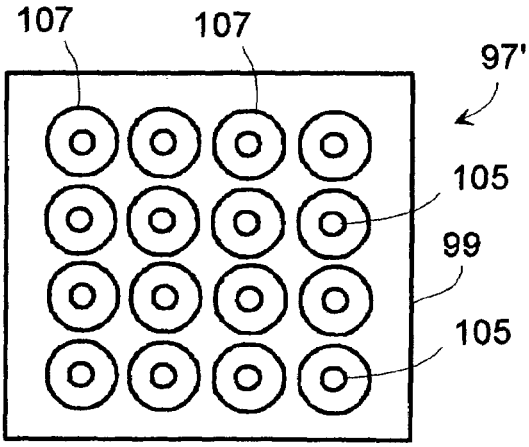
Figure 4C:
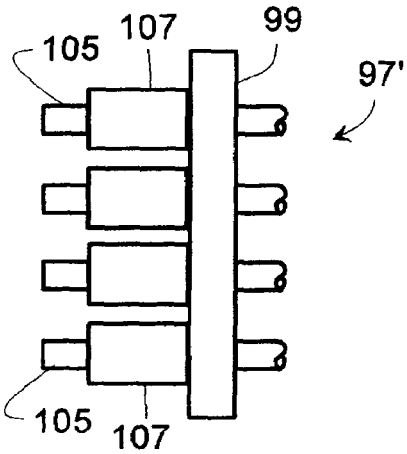

FIGS. 4A, 4B, and 4C are similar to FIGS. 3A, 3B, and 3C, but the means for anchoring cable shown at an end of the barrier wall is a second means for anchoring cable 97', the difference being the number of tension cables in the cable system anchored: 16 instead of 4.

Figure 5A:
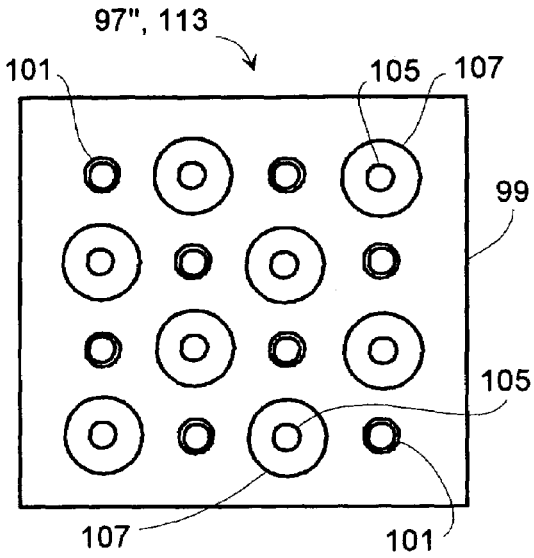
FIGS. 5A and 5B show respectively an end view and a side view (where the latter could also be a top or bottom view) of a third means for anchoring cable. This third means for anchoring cable accommodates tension cables from both sides of a steel plate, with the cables from either side of the steel plate alternating with one another in sequential positions comprising an array pattern.
Figure 5B:
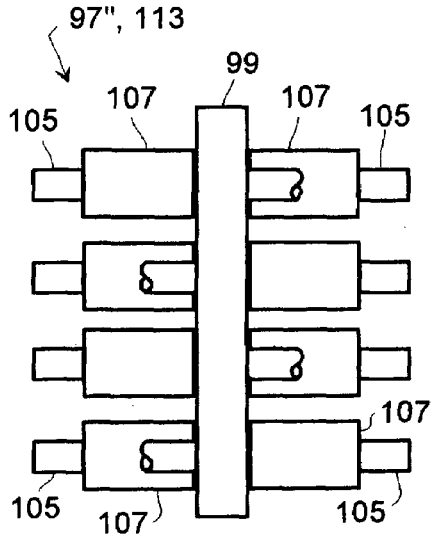

FIGS. 5A and 5B show respectively an end view and a side view (where the latter could also be a top or bottom view) of a third means for anchoring cable 97", one which comprises a means for decoupling cable strain 113. This third means for anchoring cable 97" accommodates cable ends 105 of tension cables from both sides of a steel plate 99, with the cables from either side of the steel plate alternating with one another in sequential positions comprising an array pattern. As with the first and second means for anchoring cable 97 and 97', the cable ends 105 are obstructed from being pulled back through cable-routing holes 101 in the steel plate 99 by obstructing devices 107 attached respective to the cable ends 105.

Figure 5C:
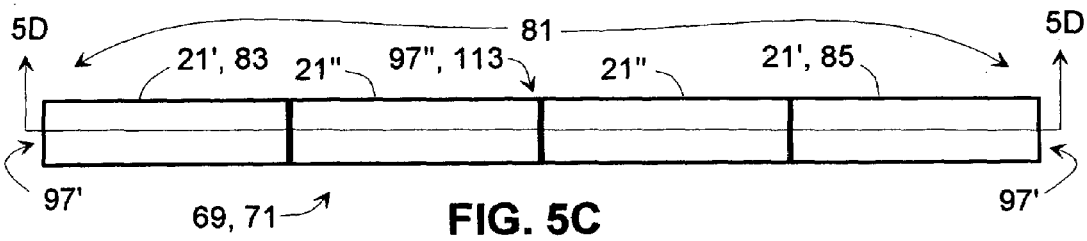
FIGS. 5C and 5D show respectively a front view and a cross-sectional front view of a barrier wall comprised of four masses of composite material. The third means for anchoring cable, shown in FIGS. 5A and 5B, is used between the two masses on the left and the two masses on the right of this barrier wall. The masses at the ends of the wall are of the second embodiment, whereas the masses at the middle portion of the wall are of a third embodiment that has its opposite ends configured with one of each of the first and second embodiments respectively. The third means for anchoring cable is used at the middle of this barrier wall as a means for decoupling strains between cables on the two opposite sides of the steel plate.
Figure 5D:
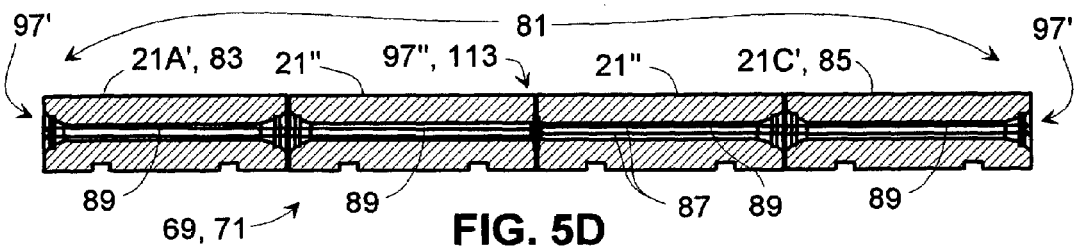

FIGS. 5C and 5D show respectively a front view and a cross-sectional front view of a cabled massive security barrier 69, or barrier wall 71, comprised of four masses of composite material and means for anchoring cable 97' and 97' located at the opposite ends 81 of the barrier wall 71. The tension cable that holds the four masses together is shown designated by four length-portions 89 respective to each mass. The third means for anchoring cable 97", shown in FIGS. 5A and 5B, is used between opposite halves of this barrier wall 71. As illustrated in FIGS. 5C and 5D, the third means for anchoring cable 97" is located to the right of the two masses that are on the left end of the barrier wall 71, and located to the left of the two masses located on the right of the barrier wall 71. The two masses 21' and 21' at the ends of the wall 71 are a first end-location mass 83 and a second end-location mass 85, and both are of the second embodiment. The masses 21" and 21" at the middle portion of the wall are of a third embodiment that each have opposite ends configured identically to that of one of each of the first and second embodiments respectively. The third means for anchoring cable 97" is used at the middle of this barrier wall 71 as a first means for decoupling cable strain 113 between cables on the two opposite sides of the steel plate 99 (opposite sides shown with detail in FIG. 5B). A means for anchoring cable is not used (or shown therefore) between the two masses comprising the left half of the barrier wall 71, nor is one used between the two masses comprising the right half of the barrier wall 71.

Figure 6A:
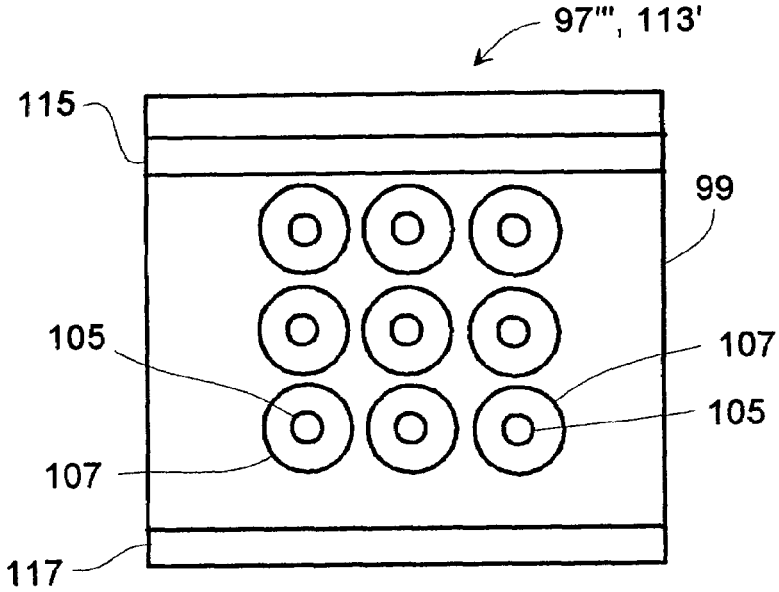
FIGS. 6A, 6B, and 6C show respectively an end view, a top view (which could also be a bottom view), and a side view of a fourth means for anchoring cable. An array of nine tension cables is anchored to a steel plate. Upper and lower linkage plates are mounted perpendicularly to the steel plate, and each linkage plate has three linkage holes, wherein the three linkage holes of one are aligned coaxial with respective ones of the other.
Figure 6B:
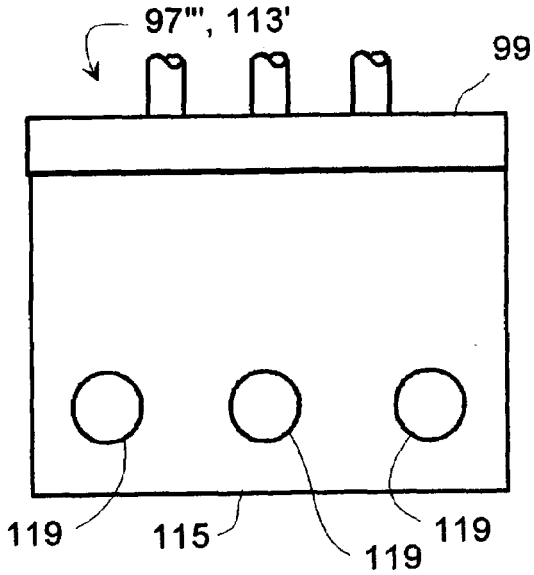
Figure 6C:
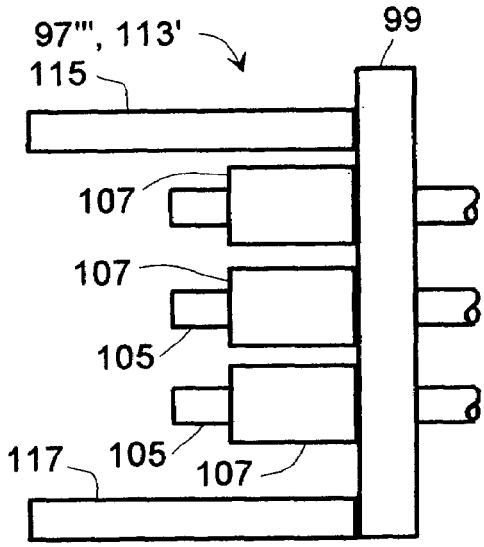

FIGS. 6A, 6B, and 6C show respectively an end view, a top view (which could also be a bottom view), and a side view of a fourth means for anchoring cable 97'". This fourth means for anchoring cable 97'" can also serve to help comprise a second means for decoupling cable strain 113'. An array of nine tension cables 105 is anchored using nine respective obstruction devices 107 to a steel plate 99. Upper and lower linkage plates 115 and 117 are mounted perpendicularly to the steel plate 99, and each linkage plate 115 and 117 has three linkage holes 119, wherein the three linkage holes 119 of one are aligned coaxial with respective ones 119 of the other.

FIGS. 7A and 7B show respectively a top view and a side view of a combined assembly of two instances of the fourth means for anchoring cable 97''' shown in FIGS. 6A–6C. These two instances of the fourth means for anchoring cable 97''' are joined together by interconnecting them with three linkage bolts 121 and their respective washers and nuts. This combination also, in some respects similar to the third means for anchoring cable 97'' shown in FIGS. 5A and 5B, comprises a means for decoupling strains 113' (that is, a second means for decoupling strains 113'). As with the first means for decoupling strains 113, if the second means for decoupling strains 113' is located and trapped between two adjacent masses, then strains in tension cable on either left-hand or right-hand side of the decoupling means can not propagate to accumulate with strain in tension cable on the opposite side.

FIGS. 7C and 7D show respectively a front view and a cross-sectional front view of a cabled massive security barrier 69, or barrier wall 71, comprised of two masses of composite material 21A' and 21C' of the second embodiment, with a fifth means for anchoring cable 97'''' and 97'''' located at the opposite ends 81 of the barrier wall 71, and the second means for decoupling strains 113', as shown in FIGS. 7A and 7B, located in between. This fifth means for anchoring cable 97'''' would be the same as illustrated for the second means for anchoring cable 97' illustrated in FIGS. 6A–6C except without the existence of the upper and lower linkage plates 115 and 117. The cable system 87 is shown comprised of two independent length-portions of tension cable 89 and 89 corresponding respectively to the two masses 21A' and 21C', wherein each length-portion of tension cable 89 is comprised of an array of nine parallel and side-by-side segments of tension cable. With the barrier wall 71 comprised, in this example, of only two masses 21A' and 212C', these two masses are also the first and second end-location masses 83 and 85. Note that if the two length-portions of tension cable 89 and 89 were sufficiently lengthened, the barrier wall 71 could be comprised of additional masses lying in between the same first and second end-location masses 83 and 85; the second means for decoupling strains 113' could be kept located between two masses near to the middle of the wall. Many other alternatives for the numbers and arrangements for masses, means for anchoring cable, means for decoupling strains, and their combinations should become apparent to one skilled in the art.

FIG. 8A shows an end view of an end region 47 of a fourth embodiment of a mass of composite material having a plurality of two tunnels 123. Each tunnel 45 ends with an opening located at a recessed region 49, wherein each tunnel opening and its associated recessed region are identical to those shown in FIG. 1C.

FIG. 8B shows an end view of an end region 47 of a fifth embodiment of a mass of composite material having a plurality of four tunnels 123'. Each tunnel 45 ends with an opening located at a recessed region 49, wherein each tunnel opening and its associated recessed region are identical to those shown in FIG. 1C. When using masses of composite material to build a barrier wall, each mass having one or a plurality of tunnels within them, not all of the tunnels in those with a plurality of tunnels need contain portions of tension cable comprising an overall cable system; however, having masses with a plurality of tunnels provides many options in designing, providing, and perhaps incrementally assembling an effective cable system to hold the masses together.

FIG. 9A shows two masses of the fourth embodiment 123A and 123B aligned end-to-end and interconnected (interlinked) using a loop of tension cable 125 looped through the two respectively aligned tunnel passageways 45 and 45. The two overlapped segments of tension cable 127 toward the respective two ends of the looped tension cable 125 are overlapped with one another within a means of friction-slide clamping 129. Given sufficient external force applied to attempt to separate the two masses 123A and 123B, if the means of friction-slide clamping 129 is appropriately adjusted, the overlapped segments of tension cable 127 will slip relative to one another. This slippage will cause the length of the looped tension cable 125 to increase rather than have the tension cable break apart.

FIG. 9B shows the configuration of the loop of tension cable 125 and the means of friction-slide clamping 129 used in the embodiment shown in FIG. 9A. In this view, it is more clearly shown that the two overlapped segments of tension cable 127 toward the respective two ends of the looped tension cable 125 are overlapped with one another within a means of friction-slide clamping 129. In this illustration, the ends 105 and 105 of the looped tension cable 125 are shown to be rather short, however they would generally be made much longer than shown in order to accommodate significant slippage when necessary to prevent the tension cable 125 from breaking under stress. It is not intended that this illustrative example or embodiment for looping of tension cable be limited to the arrangement and number of masses shown; multiple loops may be employed, and these loops may be contained within a single row of tunnels or routed to involve many non-axially aligned tunnels through the masses comprising a barrier wall.

Figure 10:
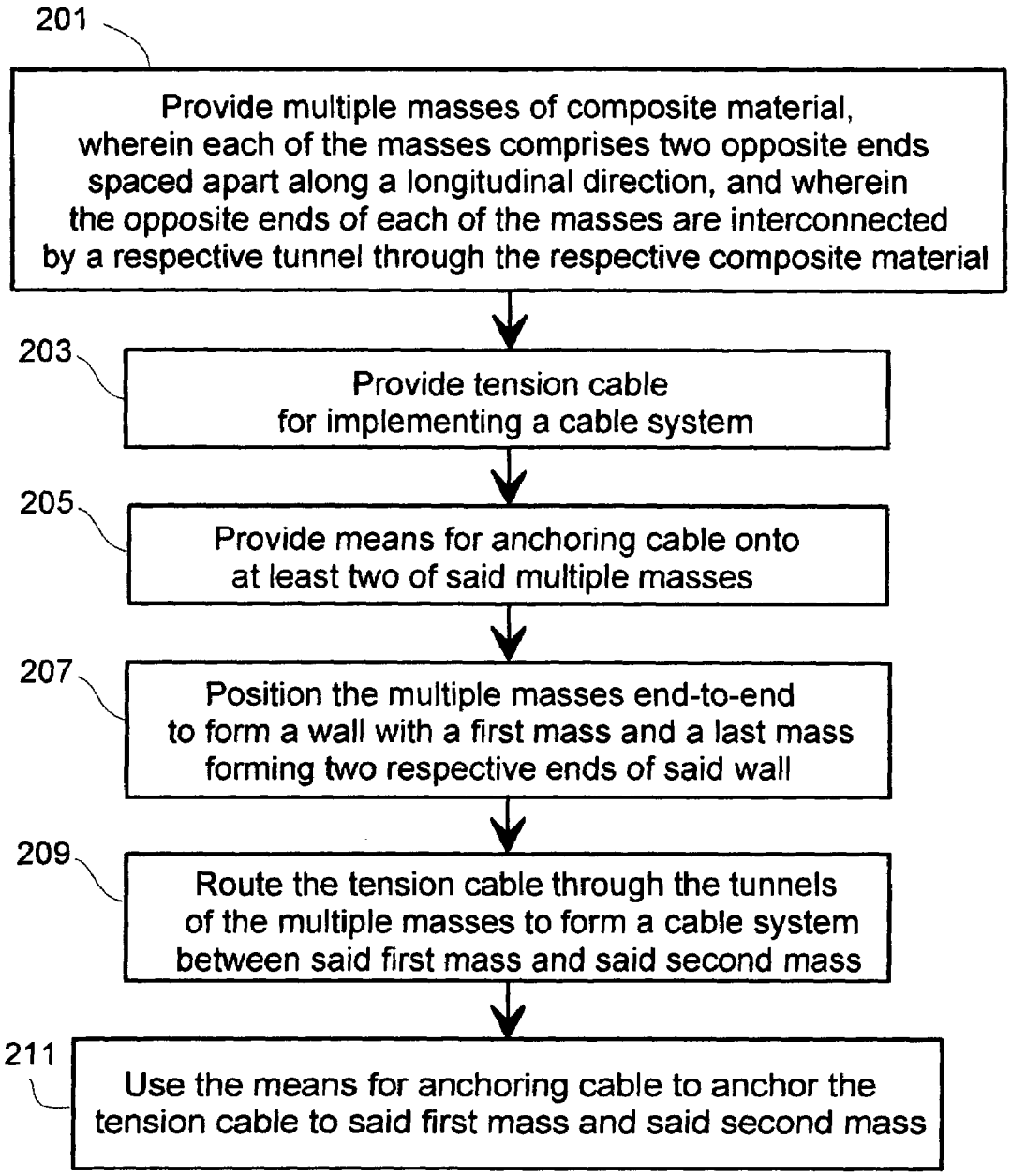
FIG. 10 shows steps in a method used to assemble a cabled massive security barrier of the present invention.

FIG. 10 shows steps in a method used to assemble a cabled massive security barrier of the present invention. Other steps and a variety of sequences will become obvious to those skilled in the art. The steps comprising the method shown are the following:

- Step 201: Provide multiple masses of composite material, wherein each of the masses comprises two opposite ends spaced apart along a longitudinal direction, and wherein the opposite ends of each of the masses are interconnected by a respective tunnel through the respective composite material;
- Step 203: Provide tension cable for implementing a cable system;
- Step 205: Provide means for anchoring cable onto at least two of said multiple masses;
- Step 207: Position the multiple masses end-to-end to form a wall with a first mass and a last mass forming two respective ends of said wall;
- Step 209: Route the tension cable through the tunnels of the multiple masses to form a cable system between said first mass and said second mass;
- Step 211: Use the means for anchoring cable to anchor the tension cable to said first mass and said second mass.

One skilled in the art will appreciate that the current invention can use many other equivalents to the disclosed and described examples of means for anchoring cable, means for decoupling strain, and means for friction-slide clamping together ends of cables. One skilled in the art will also appreciate that the current invention can use other shapes than that illustrated for the masses of composite material. Whereas barrier walls have been described and illustrated within this disclosure using examples having only a small number of individual masses of composite material arranged in a row, one skilled in the art will readily appreciated that the current invention extends to barrier walls comprised of many more than a few individual masses, that masses can be included that negotiate bends required in a barrier wall, and that the masses can be interconnected using any of a wide range of cable system configurations and designs.

Although the invention is described with respect to preferred embodiments, modifications thereto will be apparent to those skilled in the art. Therefore, the scope of the invention is to be determined by reference to the claims that follow.

We claim:

1. A cabled massive security barrier located on top of a supporting surface and comprising:

a first mass of composite material;

wherein said mass of composite material comprises an interior region and an outer surface;

wherein said outer surface includes two end regions spaced apart a distance along a longitudinal direction that is generally parallel to said supporting surface;

wherein a tunnel defined by the mass of composite material extends longitudinally through said interior region and between said end regions;

wherein a cross-sectional dimension of said tunnel increases both smoothly and nonlinearly up to at least one of said end regions along at least a portion of distance between said end regions to comprise a smoothly tapered opening;

wherein cable can be routed through the tunnel to protect the cable from damage by an explosive blast and to protect the cable from shear damage at the end regions of the tunnel;

wherein the massive security barrier can be cabled to adjacent and similar massive security barriers; and wherein the massive security barrier is free to slide along the supporting surface;

whereby said cabled massive security barrier provides for slowing a moving vehicle that collides with it, provides at least partial protection against a blast from a nearby explosion event, and provides a tunnel through which a cable can be safely routed.

2. The cabled massive security barrier of claim 1, wherein said first mass of composite material is a mass of concrete.

3. The cabled massive security barrier of claim 1, wherein said first mass of composite material includes an elastic material component.

4. The cabled massive security barrier of claim 1, wherein said tunnel has a cross-section in a plane perpendicular to the longitudinal direction, and wherein said cross-section has a shape selected from the group consisting of elliptical, circular, triangular, rectangular, square, trapezoidal, and polygonal.

5. The cabled massive security barrier of claim 1, further comprising:

a. a tunnel surface area of said tunnel;

b. an adjacent portion of said tunnel surface area, wherein said adjacent portion is adjacent to one of said end regions;

wherein said adjacent portion has a tapered contour along said longitudinal direction, and wherein said tapered contour is more than a beveled edge.

6. The cabled massive security barrier of claim 5, wherein said adjacent portion is covered by a protective liner.

7. The cabled massive security barrier of claim 6, wherein the liner has a bugle shape flaring outward toward an end of said tunnel.

8. The cabled massive security barrier of claim 1, further comprising:

a. additional and similar masses of composite material, each with a respective tunnel and end regions, arranged end-to-end to form at least a length-segment of barrier wall bounded by two of the end regions;

b. a cable system comprising at least one cable routed through at least two of the tunnels, wherein said two tunnels are adjacent to one-another; and c. means for anchoring that anchors said cable to at least one of the end regions that bounds the length-segment of barrier wall.

9. The cabled massive security barrier of claim 8, further comprising:

a. overlapped segments of the cable within said cable system; and b. means of friction-slide clamping used to clamp the overlapped segments of cable together;

whereby excessive tension force applied along said overlapped segments of cable causes the overlapped segments to slip in position relative to one another; and whereby said slip under tension absorbs energy and limits tension forces within the cable.

10. The cabled massive security barrier of claim 8, further comprising:

additional tunnels;

whereby cable can be routed through said additional tunnels.

11. The cabled massive security barrier of claim 8, wherein said means for anchoring cable comprises a steel plate having cable-routing holes through the plate.

12. The cabled massive security barrier of claim 11, further comprising:

an obstructing device fastened onto said cable at a specific location of said cable;

wherein said obstructing device prevents said specific location of said cable from passing through one of the cable-routing holes.

13. The cabled massive security barrier of claim 8, further comprising:

a recessed region in said at least one of the end regions that bounds the segment of barrier wall;

wherein said recessed region accommodates said means for anchoring cable.

14. The cabled massive security barrier of claim 8, wherein said cable has a first cable end, wherein said first cable end is securely anchored using said means for anchoring a cable.

15. The cabled massive security barrier of claim 8, further comprising:

an additional means for anchoring said cable to an additional location along said barrier wall.

16. The cabled massive security barrier of claim 15, wherein said additional means for anchoring cable comprises a means for anchoring said cable to the other end region that bounds the length-segment of barrier wall.

17. The cabled massive security barrier of claim 15, wherein said additional means for anchoring cable comprises a means for decoupling cable strain between two of the masses of composite material that are adjacent to one-another.

18. The cabled massive security barrier of claim 17, wherein said means for decoupling cable strain includes at least one bolt having a generally vertical axis situated between the two masses that are adjacent to one-another.

19. A cabled massive security barrier located on top of a supporting surface and comprising:

a. multiple masses of composite material, wherein each of the multiple masses comprises a respective interior region and a respective outer surface, wherein each of the outer surfaces includes a respective pair of end regions spaced apart along a longitudinal direction that is generally parallel to said supporting surface, and wherein each of the multiple masses has a respective tunnel extending longitudinally through its respective interior region to inter-connect each of its respective end regions;

b. a cable; and c. two instances of means for anchoring cable;

wherein said multiple masses of composite material are arranged end-to-end to form a barrier wall that is free to slide along the supporting surface and is not anchored to the supporting surface;

wherein two of the masses of composite material are end-location masses located at opposite ends of said barrier wall;

wherein each of said end-location masses includes one of said instances of means for anchoring cable;

wherein said cable is anchored to each of said end-location masses;

wherein said cable is routed through the tunnels from one of the end-location masses to the other; and wherein at least one of the tunnels is flared non-linearly near an end region;

whereby said barrier wall is held together by said cable;

whereby each of the masses of composite material can be dragged along the supporting surface, thereby pulling and dragging others of the masses also;

whereby said barrier wall provides a barrier for slowing a moving vehicle that collides with it; and whereby said barrier wall provides a barrier for at least partial protection against a blast from a nearby explosion event.

20. A method of assembling a cabled massive security barrier that is free to slide along a supporting surface, comprising the steps of:

a. providing multiple masses of composite material, wherein each of the masses comprises two opposite ends spaced apart along a longitudinal direction, wherein the opposite ends of each of the masses are interconnected by a respective tunnel through the respective mass, wherein at least one of the tunnels ends with a non-linearly flared opening, and wherein each of the masses is free to slide along the supporting surface;

b. providing cable for implementing a cable system;

c. providing means for anchoring cable to at least two of the masses;

d. positioning the masses longitudinally end-to-end to form a wall, wherein a first mass of the multiple masses and a last mass of the multiple masses comprise two respective ends to said wall;

e. routing said cable through the tunnels of said masses to form a cable system interconnecting said first mass and said last mass; and f. using the means for anchoring cable to anchor said cable to said first mass and said last mass.

21. The method of assembling a cabled massive security barrier that is free to slide along a supporting surface as set forth in claim 20, further comprising the steps of:

a. providing at least one additional means of anchoring cable;

b. using the additional means of anchoring cable to anchor the cable system to another of the masses that is other than the first mass and other than the last mass.

* * * * *